US011447887B2

(12) United States Patent
Al-Rowaili et al.

(10) Patent No.: US 11,447,887 B2
(45) Date of Patent: Sep. 20, 2022

(54) SURFACE SMOOTHING OF COPPER BY ELECTROPOLISHING

(71) Applicants: Saudi Arabian Oil Company, Dhahran (SA); King Fahd University of Petroleum & Minerals, Dhahran (SA)

(72) Inventors: Fayez Nasir Al-Rowaili, Dhahran (SA); Mazen Khaled, Ardross (AU); Aqil Jamal, Dhahran (SA); Sagheer A. Onaizi, Dhahran (SA); Umer Zahid, Dhahran (SA)

(73) Assignees: Saudi Arabian Oil Company, Dhahran (SA); King Fahd University of Petroleum & Minerals, Dhahran (SA)

( * ) Notice: Subject to any disclaimer, the term of this patent is extended or adjusted under 35 U.S.C. 154(b) by 0 days.

(21) Appl. No.: 17/118,115

(22) Filed: Dec. 10, 2020

(65) Prior Publication Data

US 2022/0186399 A1 Jun. 16, 2022

(51) Int. Cl.

| | |
|---|---|
| ***C25F 3/22*** | (2006.01) |
| ***C25B 3/26*** | (2021.01) |
| ***C25B 11/042*** | (2021.01) |

(52) U.S. Cl.

CPC ..... *C25F 3/22* (2013.01); *C25B 3/26* (2021.01); *C25B 11/042* (2021.01)

(58) Field of Classification Search

CPC ..... C25F 3/22

See application file for complete search history.

(56) References Cited

U.S. PATENT DOCUMENTS

| | | | | |
|---|---|---|---|---|
| 2,694,678 | A | 1/1951 | George et al. | |
| 2,645,611 | A * | 7/1953 | Axtell | C25F 3/22 205/671 |
| 2,753,301 | A | 7/1956 | Bersworth et al. | |
| 7,112,271 | B2 | 9/2006 | Jo et al. | |
| 7,501,051 | B2 * | 3/2009 | Shieh | C25F 3/02 205/677 |
| 9,481,938 | B2 | 11/2016 | Shin et al. | |
| 10,131,602 | B1 | 11/2018 | Gondal et al. | |
| 10,161,051 | B2 | 12/2018 | Palmore et al. | |

(Continued)

FOREIGN PATENT DOCUMENTS

| | | |
|---|---|---|
| CN | 105386124 | 3/2016 |
| CN | 107177862 | 9/2017 |

(Continued)

OTHER PUBLICATIONS https://web.archive.org/web/20200919155301/https://www.gamry.com/application-notes/instrumentation/two-three-four-electrode-experiments/ (Year: 2020).*

(Continued)

*Primary Examiner* — Brian W Cohen

(74) *Attorney, Agent, or Firm* — Fish & Richardson P.C.

(57) ABSTRACT

A method for forming an atomically smooth surface on a copper electrode through electropolishing and the atomically smooth surface are provided. An exemplary method for forming an atomically smooth surface by electropolishing includes placing a copper foil in an electrolyte solution including ethylene glycol and phosphoric acid. The copper foil is coupled to a current source. Current is applied to the copper foil to electropolish the copper foil. The electropolishing is stopped when the electropolishing is completed.

11 Claims, 5 Drawing Sheets

200

(56) References Cited

U.S. PATENT DOCUMENTS

| | | | | |
|---|---|---|---|---|
| 10,329,677 | B2 | 6/2019 | Geioushy et al. | |
| 10,590,548 | B1 | 3/2020 | McGinnis | |
| 2004/0262168 | A1 | 12/2004 | Huo et al. | |
| 2008/0067077 | A1 | 3/2008 | Kodera et al. | |
| 2010/0193370 | A1 | 8/2010 | Olah et al. | |
| 2011/0114502 | A1 | 5/2011 | Cole et al. | |
| 2013/0256124 | A1 | 10/2013 | Rahman et al. | |
| 2014/0246399 | A1 | 9/2014 | Chiba | |
| 2015/0004329 | A1* | 1/2015 | Abuhimd | C25F 3/22 427/551 |
| 2015/0047986 | A1 | 2/2015 | Shin et al. | |
| 2017/0073824 | A1 | 3/2017 | Kudo et al. | |
| 2019/0035640 | A1 | 1/2019 | Thorkelsson et al. | |
| 2019/0067706 | A1 | 2/2019 | Liu et al. | |

FOREIGN PATENT DOCUMENTS

| | | |
|---|---|---|
| EP | 0892862 | 1/1999 |
| EP | 1967616 | 9/2008 |
| WO | 2006037584 | 4/2006 |
| WO | 2011063353 | 5/2011 |
| WO | 2016193736 | 12/2016 |

OTHER PUBLICATIONS

"Electrolytic Polishing of Copper and Nickel Silver" by Halle Abrams, Masters of Science in Chemical Engineering at Newark College of Engineering. (Year: 1965).*

Awad et al "Removal of tarnishing and roughness of copper surface by electropolishing treatment" Applied Surface Science, 2010, 256, p. 4370-7375. (Year: 2010).*

Kwon et al "Controlled electropolishing of copper foils at elevated temperature" Applied Surface Science, 2014, 307, p. 731-735. (Year: 2014).*

U.S. Appl. No. 17/118,075, Al-Rowaili et al., filed Dec. 10, 2020.

Kang et al., "Effect of copper surface morphology on grain size uniformity of graphene grown by chemical vapor deposition." Current Applied Physics 19.12, 2019, 1414-1420, 7 pages.

Qin et al., "Roughness of copper substrate on three-dimensional tin electrode for electrochemical reduction of CO2 into HCOOH" Journal of $CO_2$ Utilization 21, 2017, 219-223, 5 pages.

Uemoto et al., "Electrochemical Carbon Dioxide Reduction in Methanol at Cu and Cu2O-Deposited Carbon Black Electrodes." ChemEngineering 3.1, 15, 2019, 10 pages.

Chen et al., "Electrochemical reduction of carbon dioxide to ethane using nanostructured Cu2O-derived copper catalyst and palladium (II) chloride" The Journal of Physical Chemistry C. 119.48, Dec. 2015, 26875-26882, 8 pages.

Wang, "Electrolytic Coloring of Copper," Diandu Yu Huanbao, vol. 8, No. 5, 1988, 10-11, 1 page (English Abstract Only).

Huo et al., "Study of anodic layers and their effects on electropolishing of bulk and electroplated films of copper." Journal of applied electrochemistry 34.3, Mar. 2004, 305-314, 10 pages.

PCT International Search Report and Written Opinion in International Appln. No. PCT/US2021/062701, dated Apr. 4, 2022, 15 pages.

Du et al., "Mechanistic studies of Cu electropolishing in phosphoric acid electrolytes." Journal of The Electrochemical Society 151.6, Apr. 2004, 4 pages.

Heidari et al., "Kinetic model of copper electrodeposition in sulfate solution containing trisodium citrate complexing agent." Russian Journal of Electrochemistry 52.5, May 2016, 470-476, 7 pages.

Le et al., "Electrochemical reduction of CO2 to CH3OH at copper oxide surfaces." Journal of the Electrochemical Society 158.5, Mar. 2011, 5 pages.

PCT International Search Report and Written Opinion in International Appln. No. PCT/US2021/062700, dated Mar. 31, 2022, 16 pages.

* cited by examiner

100

200

SURFACE SMOOTHING OF COPPER BY ELECTROPOLISHING

TECHNICAL FIELD

The present disclosure is directed to smoothing a surface of a metal electrode. More specifically, the disclosure is directed to the electropolishing of a copper electrode to form an atomically smooth surface.

BACKGROUND

The rising concentration of $CO_2$ in the atmosphere and its contributions to atmospheric instability have prompted numerous projects into the use or sequestration of the gas. For example, research has continued on the catalytic production of fuels or chemicals from $CO_2$, such as from power plant exhausts and other waste streams including high concentrations of $CO_2$. One technique for generating fuels and chemicals from $CO_2$ is the use of electrochemical reduction. Electrochemical reduction has numerous advantages, including simplicity, low cost, and the ability to use electrical power from renewable resources, such as solar or wind power.

SUMMARY

An embodiment described in examples herein provides a method for forming an atomically smooth surface by electropolishing. The method includes placing a copper foil in an electrolyte solution including ethylene glycol and phosphoric acid. The copper foil is coupled to a current source. Current is applied to the copper foil to electropolish the copper foil. The electropolishing is stopped when the electropolishing is completed.

Another embodiment described in examples herein provides a copper catalyst. The copper catalyst includes a surface smoothed by electropolishing. The electropolishing is performed by placing a surface of the copper catalyst in contact with an electrolyte solution including phosphoric acid and ethylene glycol. The copper catalyst is coupled to a current source. Current is applied to the copper catalyst to electropolish the surface of the copper catalyst. The electropolishing is stopped when the electropolishing is complete.

DETAILED DESCRIPTION

The product of the electrochemical reduction of $CO_2$ largely depends on the metallic material selected as the electrode and the degree of smoothness achieved from the electropolishing step. Therefore, to increase the yield from the electrochemical reduction of $CO_2$, the electrode is smoothed prior to the use. An atomically smooth surface enhances the electrodeposition of a catalyst layer and the yield of the electrochemical reduction of $CO_2$.

Techniques are provided herein for electropolishing copper surfaces to form atomically smooth surfaces for electrodeposition of electrochemical catalysts. The surface morphology and, thus, the surface smoothing resulting from the electropolishing is largely influenced by the adsorption of electrolyte ions. Accordingly, the electrolyte used for the electropolishing is a solution of ethylene glycol and phosphoric acid.

In some embodiments, the electropolished copper surface is used to enhance the controlled deposition of $Cu_2O$, for example, as an electrochemical catalyst for the reduction of $CO_2$. The electrochemical reduction of $CO_2$ utilizes a low-cost waste feedstock for the generation of petrochemicals, such as methanol. The methanol may be used to generate other chemicals such as ethanol, hydrocarbons, propanol, and formic acid. The capture of the $CO_2$ may assist in sequestration, and widespread adoption of the techniques may help to reduce the total amount of atmospheric $CO_2$. The methanol generated in the techniques may be used as a fuel, for example, in fuel cells, combustion engines, and the like.

Figure 1:
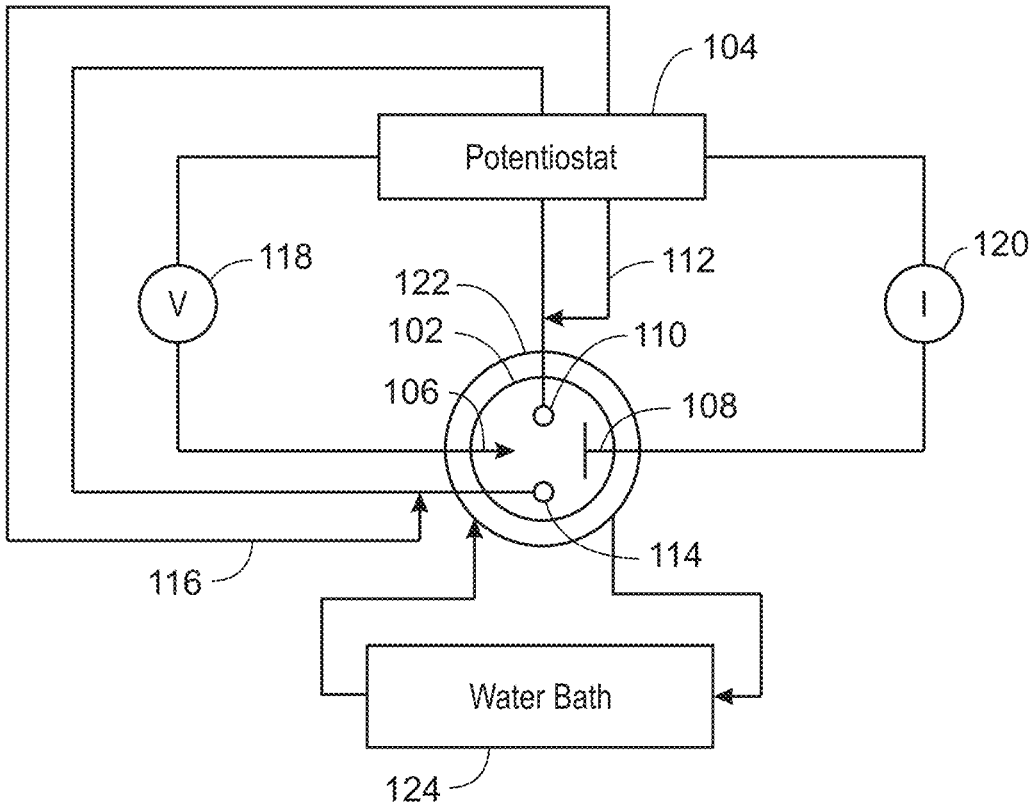
FIG. 1 is a drawing of an electrochemical cell used for the electropolishing of a surface of copper foil.

FIG. 1 is a drawing 100 of an electrochemical cell 102 used for the electropolishing of a surface of copper foil. A potentiostat 104 is coupled to electrodes in the electrochemical cell 102, such as a reference electrode 106, a counter electrode 108, and a working electrode 110. The potentiostat 104 provides current to the electrodes 106-110 to complete the electropolishing. In this embodiment, the working electrode 110 has a sense line 112 coupled between the working electrode 110 and the potentiostat 104 to measure the voltage potential between the reference electrode 106 and the working electrode 110.

In some embodiments, a second working electrode 114 is coupled to the potentiostat 104 to allow two copper foils to be electropolished at the same time. In the embodiment shown, a second sense line 116 is coupled between the second working electrode 114 and the potentiostat 104 to measure the voltage potential between the second working electrode 114 and the reference electrode 106.

The sense lines 112 and 116 allow the voltage 118 between the working electrodes 110 and 114 and the reference electrode 106 to be measured and controlled by the potentiostat 104. In some embodiments, the current 120 flowing through the electrochemical cell 102 is measured on the line to the counter electrode 108 and controlled by the potentiostat. In some embodiments, the counter electrode 108 is another copper foil.

In some embodiments, the electrochemical cell 102 has a water jacket 122 to control the temperature of the electrochemical reaction in the electrochemical cell 102. In the embodiment shown, the water jacket 122 is coupled to a water bath 124 for temperature control. In other embodiments, the electrochemical cell 102 is partially submerged in the water bath 124.

For larger applications, an electrochemical cell with up to three electrodes, the working and the reference electrodes, may be placed inside a cathodic chamber. In this embodiment, the counter electrode is located in an anodic chamber, which is open to the atmosphere. An ion-exchange membrane is placed between the separated chambers to prevent the transportation of the oxygen gas evolved at the anodic cathode from reaching the cathodic chamber and oxidizing the products during electrolysis.

$CO_2$ is introduced into the cathodic chamber through a glass frit to remove oxygen. The dissolved $CO_2$ travels to the surface of the cathode to complete the electrocatalytic carbon dioxide reduction.

Figure 2:
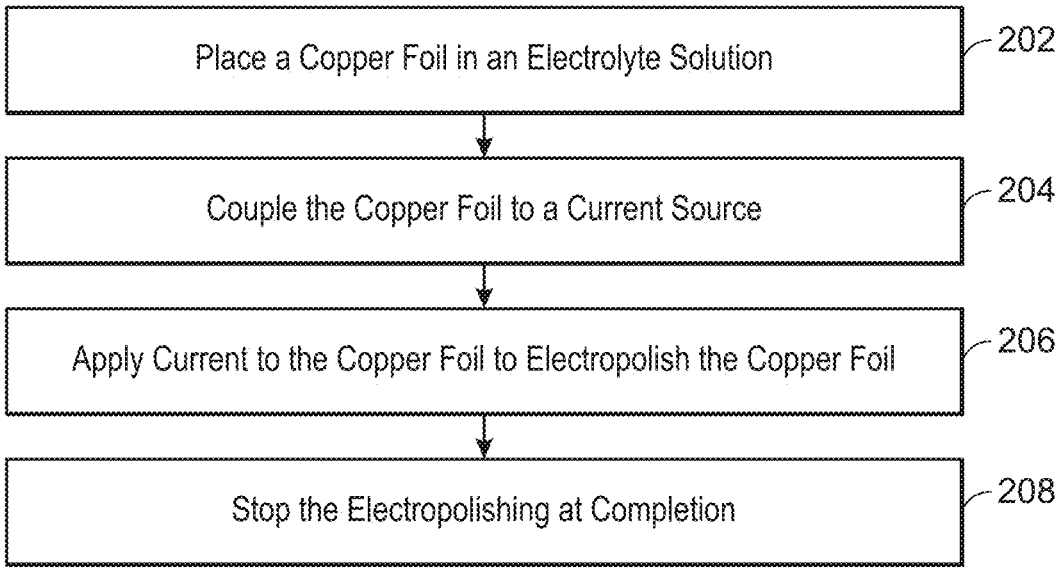
FIG. 2 is a process flow diagram of a method for electropolishing a surface of copper foil.

FIG. 2 is a process flow diagram of a method 200 for electropolishing a surface of copper foil. The method begins at block 202 when a copper foil is placed in an electrolyte solution. As described herein, the electrolyte solution includes ethylene glycol and phosphoric acid, prepared as described with respect to the examples.

At block 204, the copper foil is coupled to a current source, such as a potentiostat. The coupled copper foil is placed electrochemical cell, for example, using a Ag/AgCl reference electrode to measure voltage in the cell, and a copper foil counter electrode. In some embodiments, two copper foils are coupled to the current source for simultaneous electropolishing of both copper foils.

At block 206, current is applied to the copper foil to electropolish the copper foil. The current oxidizes the surface of the copper foil, removing copper ions. Higher and rougher features are preferentially removed, smoothing the surface. As described herein, in some embodiments, the electropolishing is performed at a current of between about 300 mA/2 $cm^2$ and 450 mA/2 $cm^2$, at a current of between about 350 mA/2 $cm^2$ and 410 mA/2 $cm^2$, or at a current of 380 mA/2 $cm^2$. In some embodiments, the temperature is controlled at between about 50° C. and about 80° C., or between about 60° C. and about 70° C., or at about 65° C.

At block 208, the electropolishing is stopped at completion, for example, when the surface has reached a satisfactory degree of smoothness. In some embodiments, the electropolishing is continued for between about 9 minutes and about 14 minutes, or for between about 10 min and about 13 minutes, or for about 11.5 minutes. In some embodiments, the completion of the electropolishing process is determined by the color of the electrolyte solution. When the electrolyte solution turns light blue, in about 11.5 minutes, the electropolishing process is stopped.

EXAMPLES

Materials and Equipment

Phosphoric acid was purchased as an 85% solution (con), e.g., pure ortho-phosphoric acid, from Sigma-Aldrich of St. Louis, Mo., USA, and used without further purification. Ethylene glycol was purchased as a neat liquid from Sigma-Aldrich and used without further purification.

An electrolyte solution of 3 M phosphoric acid and 0.2 M ethylene glycol was prepared in DI water. The electrolyte solution was prepared by adding 174.47 milliliters (mL) of the con phosphoric acid and 11.18 mL of the ethylene glycol to 814.35 mL of DI water.

Copper foil was purchased as a roll from Sigma-Aldrich. Flags were cut from the copper foil, wherein the flags had a 2 $cm^2$ square lower section, and a narrow section extending upward for coupling to wires from the potentiostat. The reference electrode used for the electropolishing was an Ag/AgCl electrode purchased from Sigma-Aldrich.

The potentiostat was a Reference 3000 model from Gamry Instruments Company of Warminster, Pa., USA. The field emission scanning electron microscope (FESEM) was a LYRA 3, Dual Beam, from Tescan, of Brno, CZ. The FESEM was coupled with an energy dispersive X-ray spectrometer (EDX) from Oxford Instruments of Abingdon, UK. The FESEM was run at an SEM HV of 15 kV, with a view field of 3.00 μm, and an SEM Magnification of 63.6 kx. The AFM was an Innova AFM from Bruker of Billerica, Mass., USA.

Procedures

Electropolishing

Copper foil of about 2 $cm^2$ of area was galvanically polished in an electrolyte solution comprising ethylene glycol and phosphoric acid (3M Phosphoric Acid+0.2M Ethylene Glycol) at a temperature of 65° C. using water circulator. The counter electrode used was a second flag-shaped copper foil and the reference electrode was an Ag/AgCl electrode. The electropolishing was performed using the potentiostat at a set current of 190 mA/$cm^2$ (380 mA/2 $cm^2$) for 11.5 minutes. More than one working electrode was electropolished at a time until the electrolyte solution changed color to light blue, indicating completion of the electropolishing.

Surface Analysis

The electropolished copper foil working electrode was examined to ascertain the level of smoothness achieved. Micrographs of the surface of the electropolished copper foil were collected using FESEM and AFM.

Figures 3A, 3B:
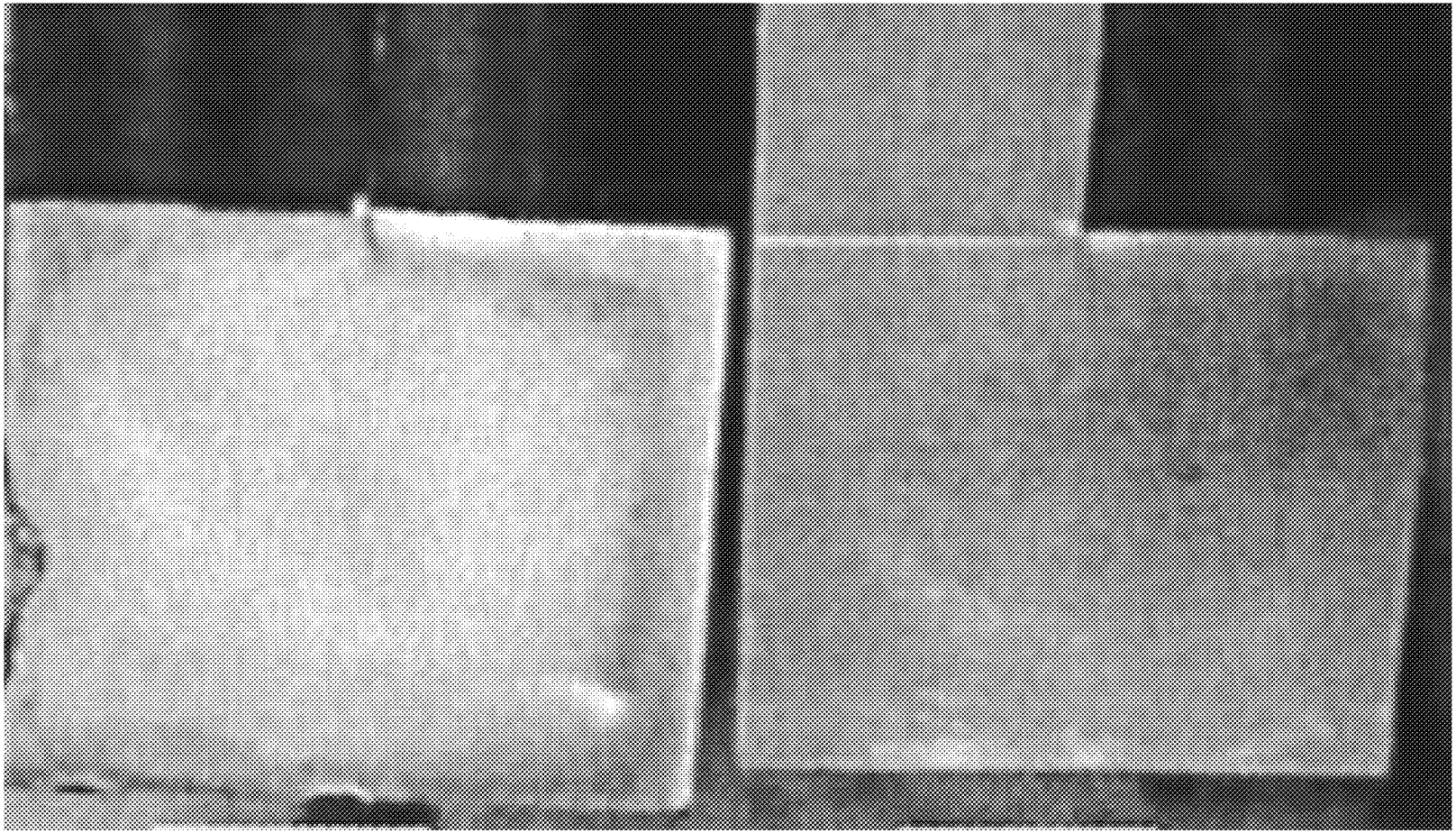
FIGS. 3A and 3B are images of a copper foil surface before and after electropolishing.

FIGS. 3A and 3B are images of an electropolished copper foil surface and a non-electropolished surface. The electropolished copper, shown in FIG. 3A, is smoother than that of the unpolished copper foil, shown in FIG. 3B, as indicated by the higher surface reflectance.

Figures 4A, 4B, 4C:
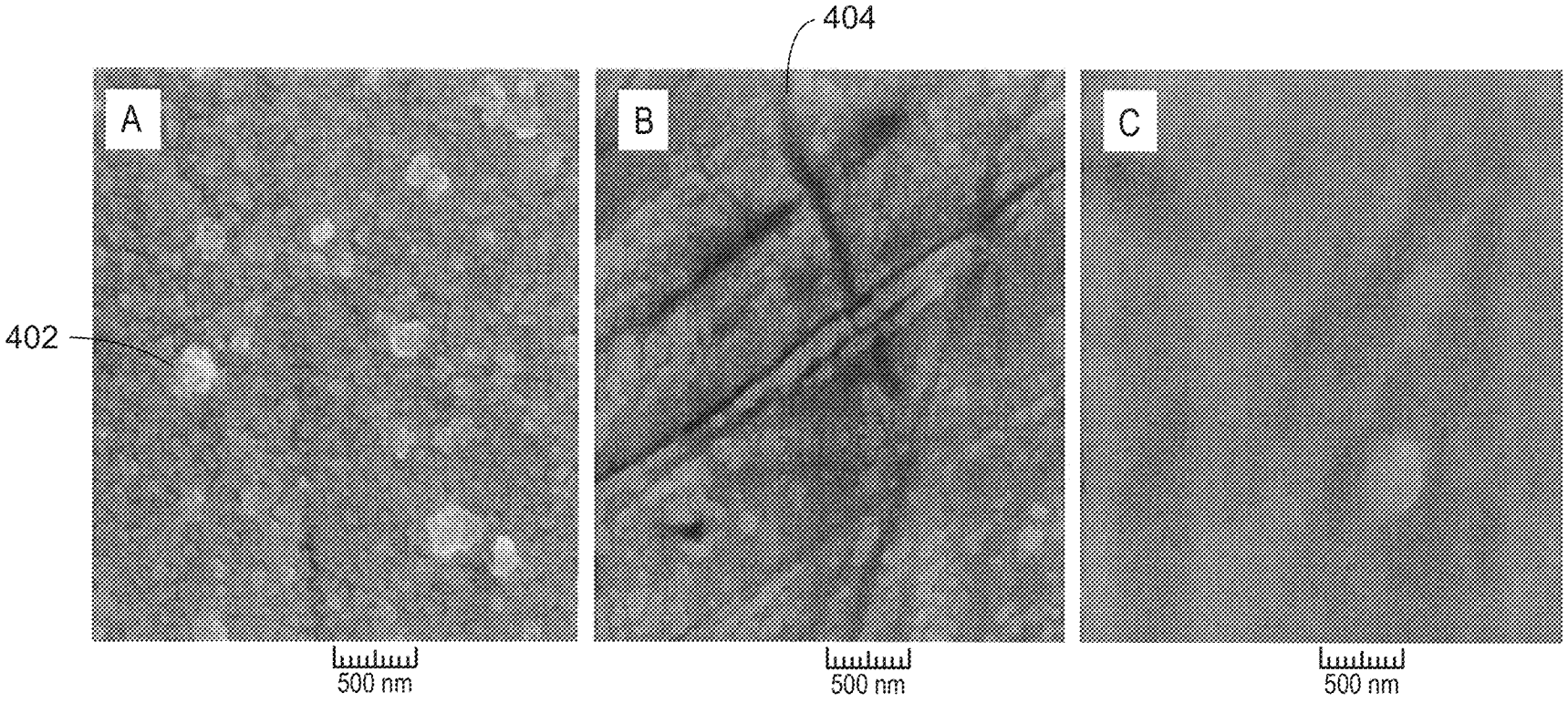
FIGS. 4A, 4B, and 4C are micrographs collected using a field emission scanning electron microscope (FESEM).

FIGS. 4A, 4B, and 4C are micrographs collected using a field emission scanning electron microscope (FESEM). FIG. 4A is a micrograph of the surface of the copper foil as received. In FIG. 4A, copper crystals 402 are visible. The copper crystals 402 may be polished to form a smoother surface. FIG. 4B shows the copper foil after polishing with 10 μm alumina particles. However, this leaves larger scratches 404 on the surface. FIG. 4C shows the surface of the copper foil after electropolishing for 5 min at 190 mA/$cm^2$ in an electrolyte solution of 3 M phosphoric Acid and 0.2 M ethylene glycol. As shown in FIG. 4C, the surface is smoother and suitable for forming catalyst for the electrochemical reduction of $CO_2$.

Figure 5A:
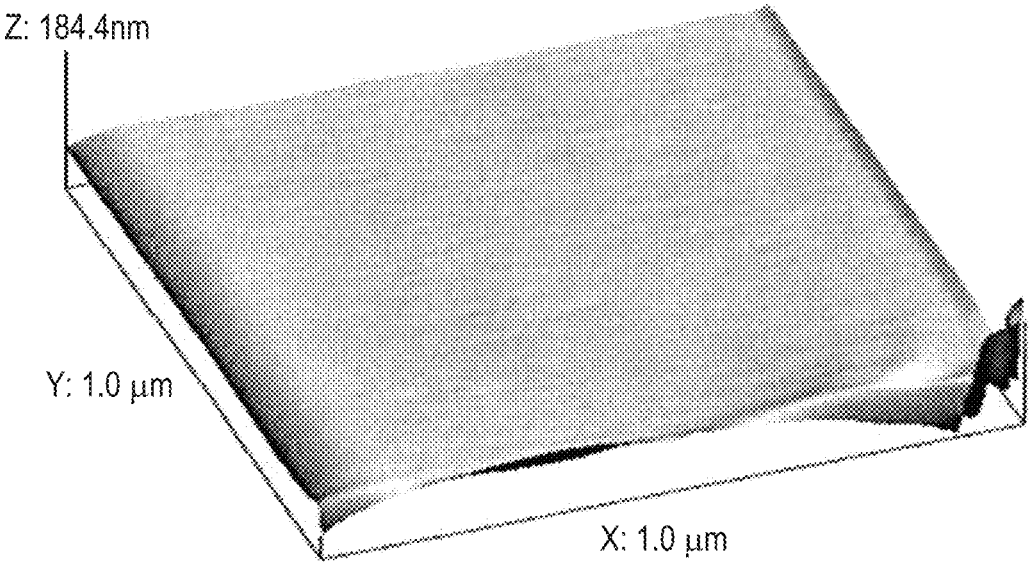
FIGS. 5A and 5B are topology results obtained from an atomic force microscope (AFM) after the electropolishing of the copper foil is completed.
Figure 5B:
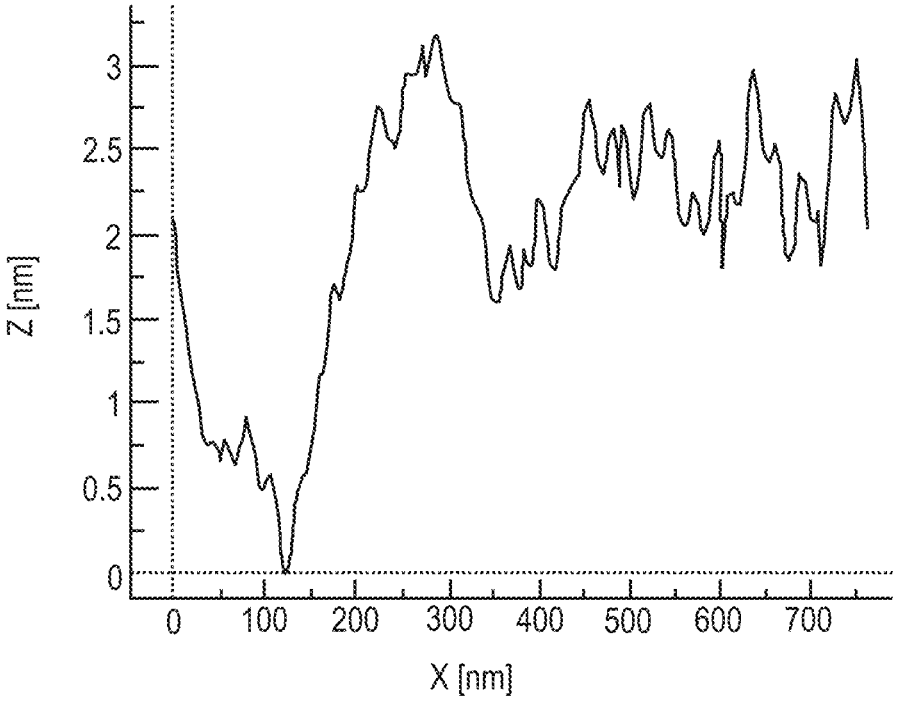

FIGS. 5A and 5B are topography results obtained with an atomic force microscope (AFM) after the electropolishing of the copper foil. In this example, the electropolishing was conducted for 11.5 minutes in the electrolyte solution of 3 M phosphoric acid and 0.2 M ethylene glycol. FIG. 5A shows the topography smooth surface in the AFM micrograph. FIG. 5B is a topography plot of an ensemble of the surface. As can be seen in the plot, the surface roughness across this cross-section varies by about 3 nm.

An embodiment described in examples herein provides a method for forming an atomically smooth surface by electropolishing. The method includes placing a copper foil in an electrolyte solution including ethylene glycol and phosphoric acid. The copper foil is coupled to a current source. Current is applied to the copper foil to electropolish the copper foil. The electropolishing is stopped when the electropolishing is completed.

In an aspect, the method includes forming the electrolyte solution by mixing an 85% phosphoric acid solution into water and then adding the ethylene glycol to the electrolyte solution. In an aspect, the method includes forming the electrolyte solution at about a 3 molar (M) concentration of phosphoric acid and about a 0.2 M concentration of ethylene glycol.

In an aspect, the method includes applying the current at about 380 mA per 2 $cm^2$ to the copper foil. In an aspect, the method includes determining that the electropolishing is completed when the electrolyte solution changes color to blue. In an aspect, the method includes determining that the electropolishing is completed after about 11.5 minutes.

In an aspect, the method includes using a counter electrode including a second copper foil. In an aspect, the method includes controlling a temperature during the electropolishing at about 65° C.

In an aspect, the method includes using the copper foil as a working electrode in an electrochemical cell. In an aspect, the method includes coupling two copper foils to the current source as working electrodes.

In an aspect, the method includes using a sense lead to monitor the current of a working electrode. In an aspect, the method includes using a Ag/AgCl electrode as a reference electrode.

Another embodiment described in examples herein provides a copper catalyst. The copper catalyst includes a surface smoothed by electropolishing. The electropolishing is performed by placing a surface of the copper catalyst in contact with an electrolyte solution including phosphoric acid and ethylene glycol. The copper catalyst is coupled to a current source. Current is applied to the copper catalyst to electropolish the surface of the copper catalyst. The electropolishing is stopped when the electropolishing is complete.

In an aspect, the electropolishing is complete when the electrolyte solution changes color to blue. In an aspect, the electropolishing is stopped after 11.5 minutes.

In an aspect, the copper catalyst includes an atomically smooth surface formed by the electropolishing. In an aspect, the electrolyte solution includes about 3 molar (M) phosphoric acid and about 0.2 M ethylene glycol. In an aspect, the current source includes a potentiostat. In an aspect, the current is at about 380 mA/2 $cm^2$. In an aspect, a temperature of the copper catalyst during application of the current is controlled at about 65° C.

Other implementations are also within the scope of the following claims.

What is claimed is:

1. A method for forming an atomically smooth surface by electropolishing, comprising:

placing a copper foil in an electrolyte solution consisting of about 0.2 molar (M) ethylene glycol and about 3 M phosphoric acid;

coupling the copper foil to a current source;

applying current to the copper foil to electropolish the copper foil; and stopping the electropolishing when the electropolishing is completed, wherein the electropolished copper foil has a surface roughness of about 3 nm.

2. The method of claim 1, comprising forming the electrolyte solution by mixing an 85% phosphoric acid solution into water and then adding the ethylene glycol to the electrolyte solution.

3. The method of claim 1, comprising applying the current at about 380 mA per 2 $cm^2$ to the copper foil.

4. The method of claim 1, comprising determining that the electropolishing is completed when the electrolyte solution changes color to blue.

5. The method of claim 1, comprising determining that the electropolishing is completed after about 11.5 minutes.

6. The method of claim 1, comprising using a counter electrode comprising a second copper foil.

7. The method of claim 1, comprising controlling a temperature during the electropolishing at about 65° C.

8. The method of claim 1, comprising using the copper foil as a working electrode in an electrochemical cell.

9. The method of claim 1, comprising coupling two copper foils to the current source as working electrodes.

10. The method of claim 1, comprising using a sense lead to monitor the current of a working electrode.

11. The method of claim 1, comprising using a Ag/AgCl electrode as a reference electrode.

* * * * *